US006848770B2

(12) United States Patent
Miyamoto et al.

(10) Patent No.: US 6,848,770 B2
(45) Date of Patent: Feb. 1, 2005

(54) LIQUID DISPENSER AND PRINTER

(75) Inventors: Takaaki Miyamoto, Kanagawa (JP); Manabu Tomita, Kanagawa (JP); Shogo Ono, Kanagawa (JP); Minoru Kohno, Tokyo (JP); Osamu Tateishi, Nagasaki (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 10/410,752

(22) Filed: Apr. 10, 2003

(65) Prior Publication Data

US 2004/0017420 A1 Jan. 29, 2004

(30) Foreign Application Priority Data

Apr. 10, 2002 (JP) ..... 2002-107291

(51) Int. Cl.[7] ..... B41J 2/05
(52) U.S. Cl. ..... 347/56; 347/64
(58) Field of Search ..... 347/56, 58, 62–64, 347/202–208

(56) References Cited

U.S. PATENT DOCUMENTS 4,438,191 A 3/1984 Cloutier et al.
4,914,562 A * 4/1990 Abe et al. ..... 347/63
5,485,185 A 1/1996 Sueoka et al.
5,870,121 A * 2/1999 Chan ..... 347/59
6,231,166 B1 5/2001 Kawai et al.
6,318,847 B1 * 11/2001 Wade ..... 347/62
6,481,831 B1 * 11/2002 Davis et al. ..... 347/62
6,491,377 B1 * 12/2002 Cleland et al. ..... 347/50
2001/0010528 A1 8/2001 Giere et al.

FOREIGN PATENT DOCUMENTS

EP 0 396 315 A1 11/1990

* cited by examiner

*Primary Examiner*—K. Feggins
*Assistant Examiner*—An H. Do
(74) *Attorney, Agent, or Firm*—Robert J. Depke; Holland & Knight LLP

(57) ABSTRACT

A liquid dispenser includes a substrate and a plurality of liquid-dispensing portions, arranged on the substrate, including at least one liquid chamber for storing liquid, one nozzle, and one heating element, wherein the heating elements are energized to heat liquid stored in the corresponding liquid chambers to eject a droplet of the liquid from the corresponding nozzles; the heating elements and the liquid chambers have a protective layer and an insulating layer therebetween; each heating element, the insulating layer, the protective layer, and each liquid chamber are arranged in that order; the insulating layer isolates the protective layer from the heating elements; and the protective layer comprises an inorganic material, protects the heating elements, has a strip shape so as to cover some of the plurality of heating elements adjacent to each other, and has slits each disposed between the heating elements. A printer includes such a liquid dispenser.

3 Claims, 4 Drawing Sheets

LIQUID DISPENSER AND PRINTER

This application claims priority to Japanese Patent Application Number JP2002-107291 filed April 10, 2002 which is incorporated herein by reference.

BACKGROUND OF THE INVENTION

1. Field of the Invention

The present invention relates to liquid dispensers and printers. The present invention particularly relates to a liquid dispenser including heating elements arranged to be adjacent to each other and a strip protective layer, having slits disposed between the heating elements, for covering such heating elements and also relates to an inkjet printer. In the protective layer, cracks are securely prevented from being caused.

2. Description of the Related Art

In recent years, needs for colored hard copies have been increasing in the field of image processing and so on. In response to such needs, the following color-copying systems have been conventionally proposed: a sublimation-dye transfer printing system, a thermofusible transfer system, an inkjet system, an electrophotographic system, and a thermal development system.

In the inkjet system, which is one of the above-mentioned systems, droplets of recording liquid (ink) are ejected from a nozzle provided in a recording head, which is a liquid dispenser, so as to form dots on an recording object, whereby a high-quality image can be output with a simple configuration. The inkjet system is classified into an electrostatic attraction method, a continuous oscillation generating method (a piezoelectric method), a thermal method, and so on, depending on the difference of methods for ejecting ink.

In the thermal method, which is one of the above-mentioned methods, bubbles are generated by locally heating ink and ink droplets are then pushed out from nozzles by the bubbles such that the ink droplets are applied to a printing object, whereby the printing of a color image is possible with a simple configuration.

A printer using the thermal method includes a so-called printer head. The printer head includes a semiconductor substrate, heating elements for heating ink, a driving circuit, which is of a logic integrated circuit type, for energizing the heating elements, and so on, wherein these components are disposed on the semiconductor substrate. Thereby, the heating elements can be densely arranged and securely energized.

In the thermal printer, in order to obtain high-quality printouts, the heating elements must be densely arranged in the printer head. In particular, in order to obtain, for example, 600 dpi printouts, the heating elements must be arranged at an interval of 42.333 $\mu$m. However, it is difficult to provide driving elements to the corresponding heating elements that are densely arranged. Therefore, the printer head further includes switching transistors that are formed on the semiconductor substrate and connected to the corresponding heating elements using integrated circuit techniques. The driving circuit, also disposed on the semiconductor substrate, drives the switching transistors to securely energize the corresponding heating elements in a simple manner.

In the printer head, the heating elements are energized to generate bubbles, ink droplets are ejected from nozzles by the bubbles, and the bubbles in a liquid chamber then disappear. Thus, the generation and disappearance of bubbles are repeated at a short time interval of several $\mu$seconds, which corresponds to the cycle time of the ejection of the ink droplets. The heating elements are adversely affected from mechanical shock caused by cavitation arising during the repetition.

Therefore, in order to protect the heating elements, the printer head further includes an insulating layer and an anti-cavitation layer on the heating elements. As shown in FIG. 4, a conventional printer head 1 similar to the above printer head includes a semiconductor substrate 2, semiconductor elements, first heating elements 3, a first insulating layer 4, wiring lines 5 for connecting the first heating elements 3 to the corresponding semiconductor elements, a second insulating layer 6, and a first anti-cavitation layer 7 functioning as a protective layer. These portions are formed according to the following procedure: a resistive layer comprising a resistive material such as tantalum, tantalum nitride, or tantalum-aluminum alloy is formed on the semiconductor substrate 2 by a sputtering method; the resistive layer is etched into the first heating elements 3; the first insulating layer 4 comprising silicon nitride or the like is formed on the first heating elements 3 by a deposition method; a layer comprising, for example, aluminum is formed on the first insulating layer 4 and then patterned to form the wiring lines 5; the second insulating layer 6 comprising silicon nitride or the like is formed on the wiring lines 5 by a deposition method; and the first anti-cavitation layer 7 comprising an inorganic material such as tantalum is then formed on the second insulating layer 6. In the conventional printer head 1 having the above configuration, the first heating element 3 has high heat resistance and superior insulating properties and is prevented from making direct contact with ink droplets, and the mechanical shock caused by the above cavitation is lowered to protect the first heating element 3.

The following techniques are disclosed in Japanese Examined Patent Application Publication No. 5-26657: a conventional technique in which anti-cavitation layers are each independently provided to corresponding heating elements and a new technique in which a strip anti-cavitation layer is provided so as to cover a plurality of heating elements.

In general, when an insulating layer and/or an anti-cavitation layer of a printer head have a small thickness, ink droplets can be ejected with a small amount of electric power because heat generated by heating elements can be effectively transmitted to ink.

However, when the thickness of the above layers is reduced, the reliability of the printer head is also lowered. That is, when the insulating layer comprising silicon nitride or the like has a small thickness, pinholes are readily caused in the insulating layer and poor step coverage is caused at regions of the insulating layer covering steps of wiring lines. Therefore, when the thickness is too small, ink penetrates the printer head through the pinholes and the regions having poor step coverage to corrode wiring lines and heating elements, thereby causing breaks therein.

Therefore, in the printer head, the insulating layer and the anti-cavitation layer must have a thickness sufficient to prevent such pinholes and poor step coverage from arising.

In the printer head, since the heating elements are repeatedly heated at a short time interval of several $\mu$seconds, which corresponds to the cycle time of the ejection of the ink droplets, a large heat stress is repeatedly applied to the insulating layer and the anti-cavitation layer. Thus, there is a problem in that the reliability of the printer head is lowered due to the penetration of ink even if the insulating layer and the anti-cavitation layer have a thickness sufficient to prevent the pinholes and poor step coverage from arising.

In particular, as disclosed in Japanese Examined Patent Application Publication No. 5-26657 described above, when the anti-cavitation layer has a strip shape so as to cover a plurality of the heating elements, cracks are readily caused and therefore the reliability is significantly lowered because stress is concentrated on one portion of the anti-cavitation layer.

The anti-cavitation layer comprising tantalum has a large compressive stress of $1.5\times e^{10}$ to $2\times e^{10}$ dynes/cm$^2$. According to an experiment, when the tantalum anti-cavitation layer is laid in a 400° C. atmosphere for 60 minutes, cracks are caused in the insulating layer comprising silicon nitride. A region where a crack is caused is shown in FIG. 4. When such a crack is caused, ink penetrates the printer head through the crack to corrode the wiring lines and the heating elements, thereby causing breaks therein.

In order to solve this problem, the following technique disclosed in the Hewlett-Packard Journal, May 1985, pp. 27–32 can be used: wiring lines are processed by a wet etching method so as to have a round corner, and end faces of the wiring lines are tapered, thereby heightening the step coverage at regions covering steps of wiring lines and thereby preventing stress concentration. This technique is effective when the wiring lines comprise only aluminum. However, in actual practice, the wiring lines comprise aluminum alloy containing silicon, copper, and the like in order to improve the characteristics thereof. Thus, when the wiring lines comprising such alloy are used, residues are formed to cause dust, which is harmful to a semiconductor manufacturing process. Accordingly, there is a problem in that this technique cannot be used for the above printer head.

SUMMARY OF THE INVENTION

The present invention has been made in order to solve the above problems and provides a liquid dispenser and a printer, wherein the liquid dispenser includes heating elements and a protective layer in which cracks can be securely prevented from being caused.

In a first aspect of the present invention, a liquid dispenser includes a substrate and a plurality of liquid-dispensing portions, arranged on the substrate, including at least one liquid chamber for storing liquid, one nozzle, and one heating element, wherein the heating elements are energized to heat liquid stored in the corresponding liquid chambers to eject a droplet of the liquid from the corresponding nozzles; the heating elements and the liquid chambers have a protective layer and an insulating layer therebetween; each heating element, the insulating layer, the protective layer, and each liquid chamber are arranged in that order; the insulating layer isolates the protective layer from the heating elements; and the protective layer comprises an inorganic material, protects the heating elements, has a strip shape so as to cover some of the plurality of heating elements adjacent to each other, and has slits each disposed between the heating elements.

In the above liquid dispenser, the heating elements each include two resistors, arranged in a substantially parallel manner and connected to each other at one end of each resistor, and are energized by applying a voltage between the other ends of the resistors; the slits extend from a face of the protective layer close to the other ends of the resistors; and the protective layer has portions that each cover at least one of the heating elements adjacent to each other and connect with each other at the side close to the connected ends of the resistors.

In a second aspect of the present invention, a printer includes a liquid dispenser equipped with a substrate and a plurality of liquid-dispensing portions, arranged on the substrate, including at least one liquid chamber for storing liquid, one nozzle, and one heating element, wherein the heating elements are energized to heat liquid stored in the corresponding liquid chambers to eject a droplet of the liquid from the corresponding nozzles; the heating elements and the liquid chambers have a protective layer and an insulating layer therebetween; each heating element, the insulating layer, the protective layer, and each liquid chamber are arranged in that order; the insulating layer isolates the protective layer from the heating elements; and the protective layer comprises an inorganic material, protects the heating elements, has a strip shape so as to cover some of the plurality of heating elements adjacent to each other, and has slits each disposed between the heating elements.

According to the first aspect, since the liquid dispenser has the above configuration, the liquid dispenser can be used for printer heads for ejecting ink droplets, droplets of various dyes, droplets for forming protective layers, and so on, micro-dispensers for dispensing liquid reagents, various measuring apparatuses, various testing units, various patterning systems in which liquid chemical agents for protecting members from being etched are used, and so on. In the liquid dispenser, since the protective layer has the slits disposed between the corresponding heating elements adjacent to each other, thermal stress can be prevented from concentrating at one portion of the protective layer, thereby preventing cracks from being caused in the protective layer. Since the protective layer has a strip shape and a large area in addition to the slits, electrostatic charges applied to the protective layer are distributed over the large protective layer, thereby reducing the potential between the protective layer and the heating elements. Thus, this protective layer has higher resistance to dielectric breakdown as compared with another protective layer provided to each heating element. Furthermore, since portions of the protective layer are separated by the slits, the spread of rapid oxidation, that is, the burnout of the protective layer, caused by short circuits can be prevented.

According to the second aspect, in the printer, cracks can be securely prevented from being caused in the protective layer for protecting the heating elements.

DESCRIPTION OF THE PREFERRED EMBODIMENTS

The embodiments of the present invention will now be described in detail with reference to the accompanying drawings.

1. First Embodiment

Figure 2:
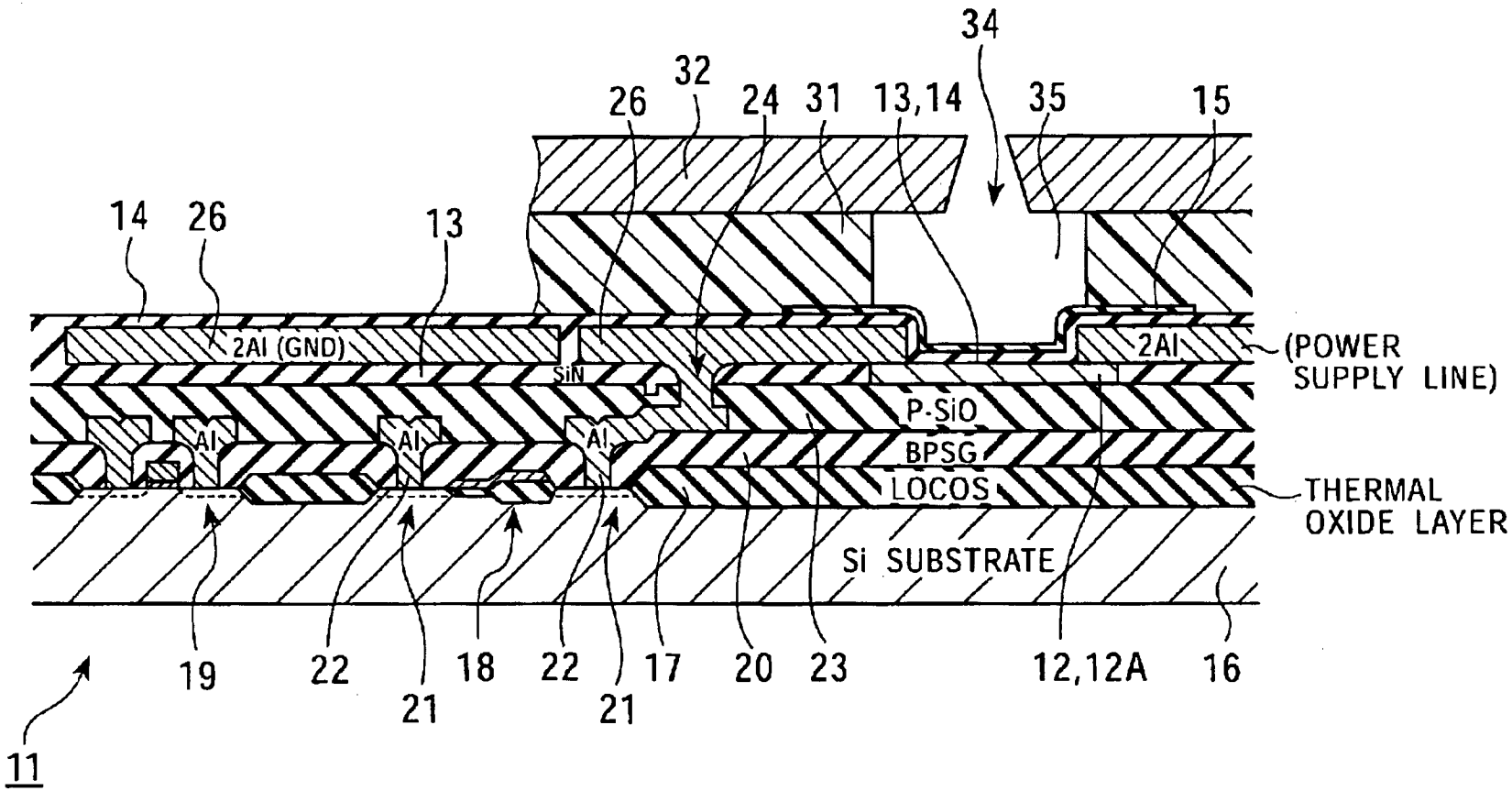
FIG. 2 is a sectional view showing the printer head shown in FIG. 1.

FIG. 2 is a sectional view showing a printer head 11 used for a printer according to an embodiment of the present invention. The printer head 11 includes second heating elements 12, third and fourth insulating layers 13 and 14 comprising silicon nitride, and a second anti-cavitation layer 15 comprising tantalum and functioning as a protective layer, wherein these portions are disposed in that order.

The printer head 11 is manufactured according to the following procedure. A silicon nitride ($Si_3N_4$) layer is formed on a p-type silicon substrate 16, which is a wafer, by a deposition method. The resulting silicon substrate 16 is processed by a photolithographic method and a reactive etching method to remove parts of the silicon nitride layer except for predetermined regions for forming transistors, thereby allowing silicon nitride portions to remain on the transistor-forming regions on the silicon substrate 16.

The resulting silicon substrate 16 is thermally oxidized to form thermal silicon oxide layers at regions where the parts of the silicon nitride layer are removed in the above step. The thermal silicon oxide layers correspond to LOCOS (Local Oxidation of Silicon) regions 17 for isolating the transistors. The silicon substrate 16 is subsequently washed. Gates are fabricated on the corresponding transistor-forming regions of the resulting silicon substrate 16, wherein the gates have a configuration in which a tantalum silicide layer, a polysilicon layer, and a thermal oxide layer are disposed in that order. The resulting silicon substrate 16 is then processed by an ion implantation method and then an oxidation method to form source regions and drain regions, thereby obtaining first transistors 18 and second transistors 19, which are of a MOS (Metal-Oxide-Semiconductor) type. Each first transistor 18 has a dielectric strength of about 25V and functions as a MOS-type driver for energizing each second heating element 12. On the other hand, each second transistor 19 is a component of an integrated circuit for controlling these drivers and operates with a voltage of 5 V. In this embodiment, lightly doped diffusion layers are each disposed between the corresponding source regions and drain regions, and the electric field of electrons flowing in the layers is lowered to prevent the dielectric breakdown of the first transistor 18.

A first interlayer insulating layer 20 comprising BPSG (Boron Phosphorus Silicate Glass), which is one of silicon oxides containing boron and phosphorus, is then formed on the resulting silicon substrate 16 by a CVD (Chemical Vapor Deposition) method. The resulting silicon substrate 16 is processed by a photolithographic method and then by a reactive etching method using gas containing $C_4H_8$, CO, $O_2$, and Ar to form contact holes 21 on the source and drain regions, which are diffusion layers on the silicon substrate 16.

The resulting silicon substrate 16 is washed with diluted hydrofluoric acid. A titanium layer having a thickness of 20 nm, a titanium nitride barrier layer having a thickness of 50 nm, and an aluminum layer having a thickness of 400–600 nm are formed above the resulting silicon substrate 16 in that order by a sputtering method, wherein these layers form a first wiring layer and the aluminum layer contains 1 atomic % silicon or 0.5 atomic % copper. The resulting silicon substrate 16 is then processed by a photolithographic method and a dry etching method to selectively remove parts of the first wiring layer, thereby forming first wiring lines 22. In the resulting silicon substrate 16, the second transistors 19, which are of a MOS type, are connected to each other with the corresponding first wiring lines 22 to form an integrated logic circuit.

A silicon oxide layer functioning as an interlayer insulating layer is formed above the resulting silicon substrate 16 by a CVD method using a TEOS (tetraethoxysilane: $Si(OC_2H_5)_4$) gas and then planarized by a CMP (Chemical Mechanical Polishing) method. Alternatively, a coating-type silicon oxide layer including a SOG (Spin on Glass) film is joined to the silicon oxide layer and then etched back to planarize the surface thereof. Thereby, a second interlayer insulating layer 23 is formed on the first wiring lines 22 connected to second wiring lines.

Tantalum is deposited on the second interlayer insulating layer 23 by a sputtering method to form a tantalum layer having a thickness of 80–100 nm. The tantalum layer is disposed above the silicon substrate 16 and functions as a resistor layer. Unnecessary portions of the tantalum layer are removed by a photolithographic method and a dry etching method using gas containing $BCl_3$ and $Cl_2$ to form resistors 12A, which are components of each second heating element 12.

Silicon nitride is deposited above the resulting silicon substrate 16 by a CVD method to form a third insulating layer 13 having a thickness of 300 nm. Predetermined portions of the third insulating layer 13 are removed by a photolithographic method and a dry etching method using gas containing $CHF_3$, $CF_4$, and Ar. Thereby, portions for connecting the second heating elements 12 to corresponding wiring lines are exposed, and openings are then provided in the second interlayer insulating layer 23 to form via-holes 24.

A titanium layer having a thickness of 20 nm and an aluminum layer having a thickness of 400–1,000 nm are formed above the resulting silicon substrate 16 in that order by a sputtering method, wherein these layers form a second wiring layer and the aluminum layer contains 1 atomic % silicon or 0.5 atomic % copper. The resulting silicon substrate 16 is then processed by a photolithographic method and a dry etching method to selectively remove parts of the second wiring pattern layer, thereby forming second wiring lines 26 used for power supply, for grounding, for connecting the first transistors 18 to the heating elements 12 and for connecting the resistors 12A, thereby obtaining the second heating elements 12.

Silicon nitride is deposited above the resulting silicon substrate 16 by a CVD method to form the fourth insulating layer 14 having a thickness of 400–500 nm and functioning as an ink-protecting layer. In a heat-treating furnace, the resulting silicon substrate 16 is then heat-treated at 400° C. for 60 minutes in an atmosphere of a nitrogen gas, an argon gas, or a mixed gas containing nitrogen and argon. Thereby, in the silicon substrate 16, the first and second transistors 18 and 19 are stabilized, and the connections between the first and second wiring lines 22 and 26 are also stabilized, thereby reducing the contact resistance.

Tantalum is deposited above the resulting silicon substrate 16 by a sputtering method to form the second anti-cavitation layer 15 having a thickness of 200 nm. A dry film 31 comprising an organic resin is bonded to the second anti-cavitation layer 15 by compression. Parts of the dry film 31 corresponding to ink chambers 35 and ink channels are removed and the dry film 31 is then cured. An orifice plate 32 is then joined to the dry film 31, wherein the orifice plate 32 has openings functioning as nozzles 34 for ejecting ink and the openings are disposed on the corresponding second heating elements 12. Thereby, the printer head 11 including the nozzles 34, the ink chambers 35, and the ink channels for each introducing ink into the corresponding ink chambers 35 is completed.

As described above, in the printer head 11, each second heating element 12 comprising tantalum, the third insulating layer 13 comprising silicon nitride, the fourth insulating layer 14 comprising silicon nitride, the second anti-cavitation layer 15 comprising tantalum, and each ink chamber 35 are disposed above the silicon substrate 16 in that order.

In the printer head 11, the ink chambers 35 and the nozzles 34 are continuously arranged in the direction perpendicular to the plane of FIG. 2 to form a line head.

Figure 1:
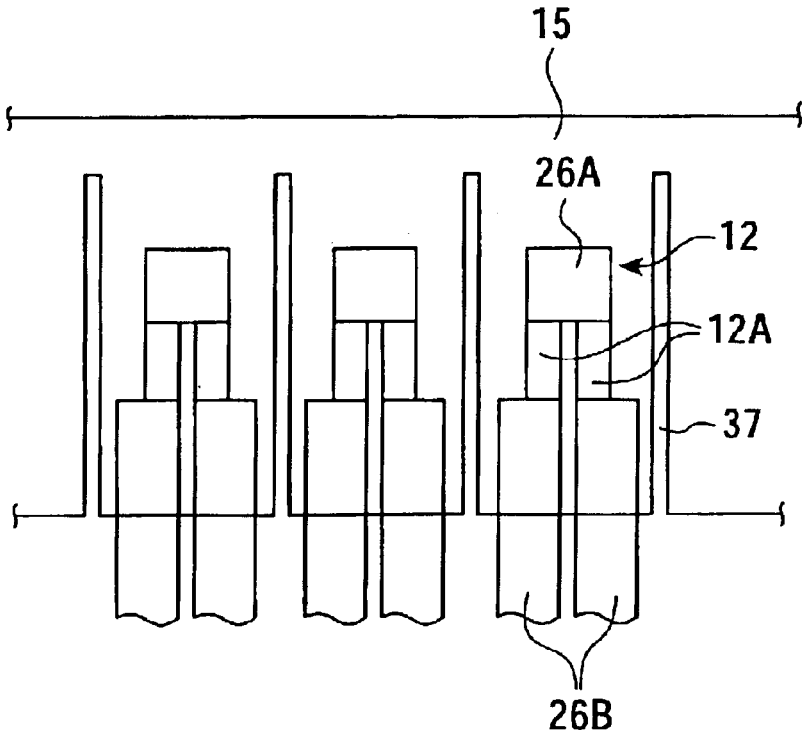
FIG. 1 is a plan view showing a printer head according to the present invention.

FIG. 1 is a plan view showing a configuration when viewed form the side of the nozzles 34, and this configuration includes the second heating elements 12, the second wiring lines 26, and the second anti-cavitation layer 15. In the printer head 11, pairs of the ink chamber 35 and the nozzles 34 are each disposed on the corresponding second heating elements 12 above the silicon substrate 16. In each second heating element 12, the two resistors 12A having a rectangular shape are arranged in a substantially parallel manner and connected to each other at each end thereof with each first electrode 26A that is a portion of each second wiring line 26. Second electrodes 26B that are also portions of the second wiring lines 26 are each connected to the other corresponding ends of the resistors 12A. Thereby, the second heating element 12 can be energized when a voltage is applied between the second electrodes 26B.

The second anti-cavitation layer 15 has a strip shape and extends so as to cover all of the second heating elements 12, the first electrodes 26A, the connections between the resistors 12A and the first electrodes 26A, and the connections between the resistors 12A and the second electrodes 26B. The second heating elements 12 are arranged such that the total length thereof is substantially equal to the width of a printing paper sheet. The second anti-cavitation layer 15 has slits 37 therein. The slits 37 each extend between the second heating elements 12 from a face of the second anti-cavitation layer 15 close to the second electrodes 26B toward the ink chambers 35. Each slit 37 extends over one end of each first electrode 26A opposite to the other end for connecting the resistors 12A to each other. Thus, the second anti-cavitation layer 15 has portions that each cover the corresponding second heating elements 12 connect with each other at the side close to the connected ends of the two resistors 12A.

2. Operation

The printer includes the printer head 11 including the silicon substrate 16, the first and second transistors 18 and 19, the second heating elements 12, the third and fourth insulating layers 13 and 14, the second anti-cavitation layer 15, the ink chambers 35, and the nozzles 34, which are formed on the silicon substrate 16 by a semiconductor-manufacturing process in that order.

In this printer, ink is introduced into the ink chambers 35, and the second heating elements 12 are then energized by the corresponding first and second transistors 18 and 19 to heat the ink stored in each ink chamber 35, thereby generating a bubble. The pressure in the ink chamber 35 is rapidly increased due to the bubble generation. The ink in the ink chamber 35 is ejected through each nozzle 34 because of the increase in pressure, thereby forming an ink droplet. This ink droplet adheres to a printing object such as a paper sheet.

In the printer, the second heating elements 12 are repeatedly energized intermittently to print a desired image on the printing object. Since the second heating elements 12 are intermittently energized, bubbles are generated and disappear in the ink chambers 35, thereby causing cavitation, which is mechanical shock. The impact of this mechanical shock is lessened by the second anti-cavitation layer 15, thereby protecting the second heating elements 12. The direct contact of the second heating elements 12 with ink is prevented by the second anti-cavitation layer 15 and the third and fourth insulating layers 13 and 14, thereby also protecting the second heating elements 12.

However, in the printer head 11, in addition to the mechanical shock, the second anti-cavitation layer 15 and the third and fourth insulating layers 13 and 14 suffer from thermal stress caused by repeatedly heating the second heating elements 12, because the second anti-cavitation layer 15 has high compressive stress with respect to temperature.

The second anti-cavitation layer 15 having a strip shape functions as a protective layer, repeatedly suffers from the thermal stress, and has slits 37 each disposed between the corresponding second heating elements 12. Therefore, stress concentration in the second anti-cavitation layer 15 can be securely prevented as compared with another one having no slits. Thereby, cracks due to the stress concentration can be securely prevented from being caused. Thus, the printer head 11 can be improved in reliability.

Since the second anti-cavitation layer 15 has the slits 37, troubles can be prevented from spreading. When breaks arise due to some causes in the second heating elements 12, the second anti-cavitation layer 15 and the second heating elements 12 are short-circuited with the third and fourth insulating layers 13 and 14 disposed therebetween in some cases depending on the condition of operation, because the second anti-cavitation layer 15 is connected to a ground potential with the ink stored in the ink chambers 35. When the second anti-cavitation layer 15 and the second heating elements 12 are short-circuited in such a manner, a large amount of current is applied to the short-circuited portions to cause a burnout of the second anti-cavitation layer 15. If the burnout is serious, the burnout extends to contact holes for the transistors, thereby damaging the transistors.

However, in the printer head 11 according to this embodiment, if the burnout arises, the burnout can be prevented from spreading over the second heating elements 12 adjacent to each other with the slits 37.

In particular, in this printer head 11, since the slits 37 extend from a voltage-applying side, in which the above burnout is apt to arise, to another side opposite to the voltage-applying side in the second anti-cavitation layer 15, the burnout can be securely prevented from spreading. Furthermore, since the slits 37 extend to portions beyond the first electrodes 26A, the burnout can be also securely prevented from spreading.

The following method may be proposed: the second anti-cavitation layer 15 is provided to each second heating element 12 in order to merely prevent the stress concentration and the spread of the burnout.

However, in some cases, an electrostatic charge stored in paper sheets is discharged in the printer head 11. In such a case, the electrostatic charge is transmitted through some particular nozzles 34 and then applied to the second anti-cavitation layer 15. Therefore, a large potential is instantaneously generated between the second heating element 12 and the second anti-cavitation layer 15 grounded with the ink having high impedance.

In this case, when each second heating element 12 has the second anti-cavitation layer 15, the potential instantaneously generated is extremely large because the capacitance between the second heating element 12 and the second anti-cavitation layer 15 is small. Thereby, the dielectric breakdown of the third and fourth insulating layers 13 and 14 is caused. When the breakdown is caused, the transistors of the printer head 11 are also damaged.

However, in this embodiment, since the second anti-cavitation layer 15 covering all of the second heating elements 12 has a large area, the capacitance between the second anti-cavitation layer 15 and the second heating elements 12 is large. Therefore, when an electrostatic charge is applied, a large potential sufficient to cause the dielectric breakdown can be prevented from being generated, thereby preventing the breakdown.

3. Advantages

As described above, when a strip protective layer covering heating elements adjacent to each other has slits each disposed between the corresponding heating elements, cracks can be securely prevented from being caused in the protective layer. Furthermore, burnouts due to short circuits established between the heating elements and the protective layer can be prevented from spreading. Furthermore, dielectric breakdown due to an electrostatic charge can be securely prevented.

In particular, the slits extend from a voltage-applying side to regions near another side opposite to the voltage-applying side in the protective layer, and portions of the protective layer covering the heating elements connect with each other at the regions. Thereby, the burnouts due to the short circuits established between the heating elements and the protective layer can be securely prevented from spreading.

4. Other Embodiments

In the above embodiment, the anti-cavitation layer functioning as a protective layer comprises tantalum. However, the present invention is not limited to such a configuration and covers various modifications. The anti-cavitation layer may comprise another material such as tantalum nitride or tantalum alloy including tantalum-aluminum alloy and tungsten-tantalum alloy. Furthermore, the anti-cavitation layer may comprise a high melting metal material such as nickel, chromium, molybdenum, or tungsten other than tantalum.

In the above embodiment, the heating elements each include the resistors, connected to each other, extending in a substantially parallel manner. However, the present invention is not limited to such a configuration and covers various modifications. Various heating elements having another configuration can be used.

Figure 3:
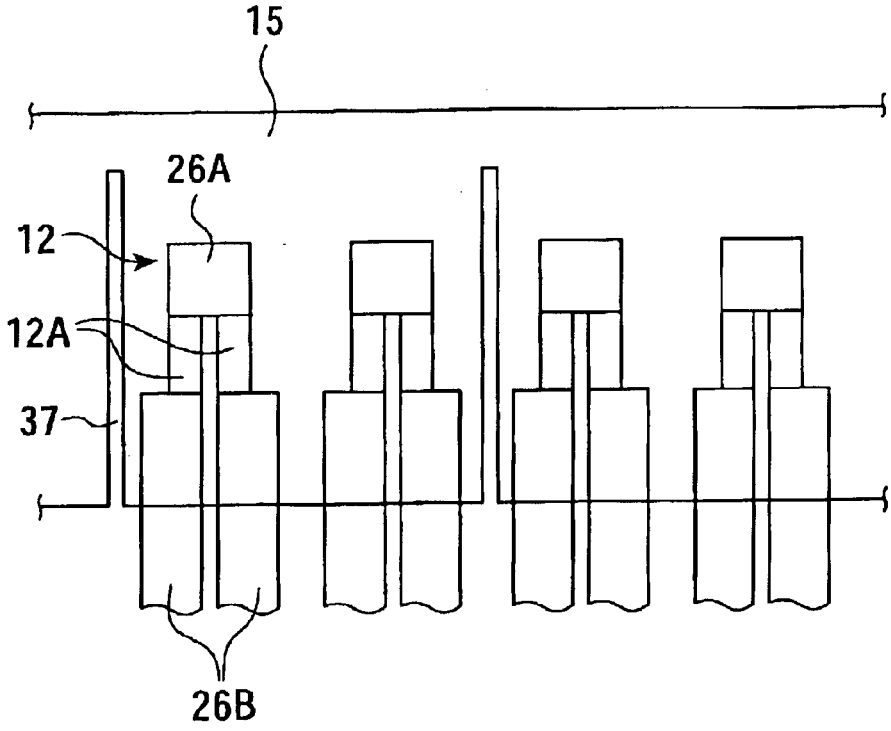
FIG. 3 is a plan view showing another printer head according to another embodiment of the present invention.
Figure 4:
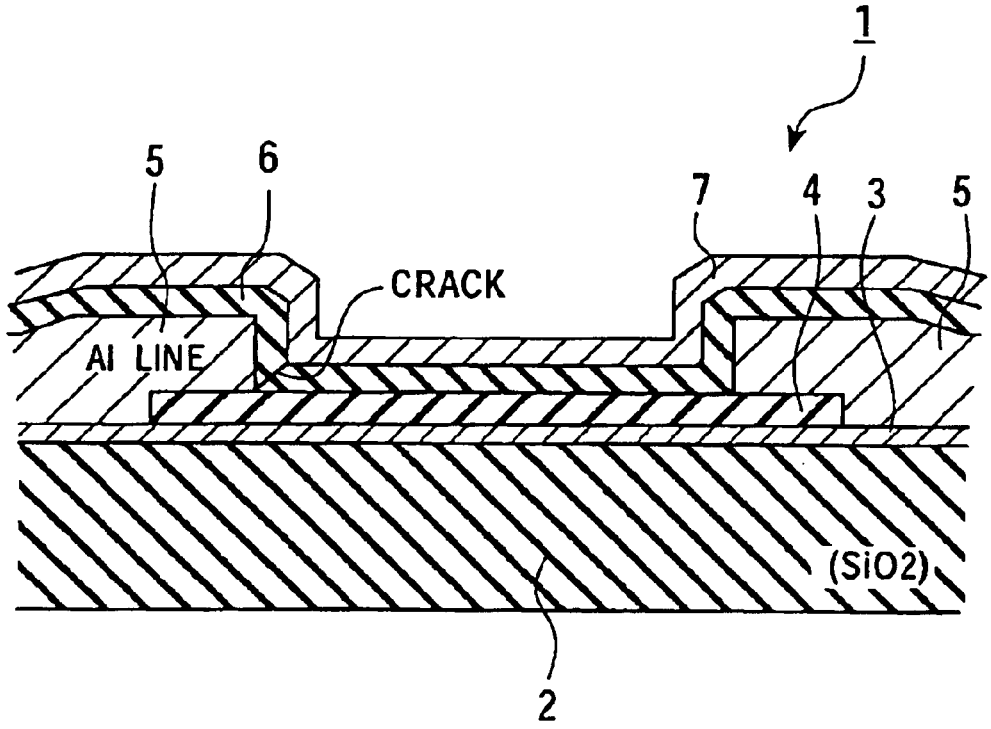
PRIOR ART FIG. 4
FIG. 4 is a sectional view showing a conventional printer head.

In the above embodiment, the anti-cavitation layer having a strip shape covers all of the heating elements and has slits disposed between all the corresponding heating elements. However, the present invention is not limited to such a configuration. If stress concentration can be securely prevented in a practical use, the slits may be each disposed between two pairs of the heating elements, as shown in FIG. 3 used for comparison with FIG. 1. Alternatively, the slits may be selectively arranged at regions at which stress intensely concentrates. Furthermore, the strip anti-cavitation layer may not cover all of the heating elements but some of the heating elements.

In the above embodiment, the heating elements comprise tantalum. However, the present invention is not limited to such a configuration and covers various modifications. The heating elements may comprise various layering materials.

In the above embodiment, the driving elements and the driving circuit for driving the driving elements are monolithically integrated on the substrate. However, the present invention is not limited to such a configuration and covers various modifications. The driving elements alone may be arranged on the substrate.

In the above embodiment, the printer head ejects ink droplets and is included in the printer. However, the present invention is not limited to such a configuration and covers various modifications. The printer head may eject droplets of various dyes or droplets for forming protective layers other than the ink droplets. Furthermore, the printer head may be generally used for micro-dispensers for dispensing liquid reagents, various measuring apparatuses, various testing apparatuses, various patterning systems in which liquid chemical agents for protecting members from etching are used, and so on.

As described above, according to the present invention, the anti-cavitation layer functioning as a protective layer and having a strip shape covers the heating elements adjacent to each other and has the slits disposed between the corresponding heating elements. Thereby, cracks are securely prevented from being caused in the anti-cavitation layer for protecting the heating elements.

What is claimed is:

1. A liquid dispenser comprising:

a substrate and a plurality of liquid-dispensing portions, arranged on the substrate, each liquid dispensing portion including at least one liquid chamber for storing liquid, one nozzle, and one heating element, wherein the heating elements are energized to heat liquid stored in the corresponding liquid chambers to eject a droplet of the liquid from the corresponding nozzles;

the heating elements and the liquid chambers have a protective layer and an insulating layer the insulating layer isolates the protective layer from the heating elements;

and the protective layer protects the heating elements, and has a strip shape covering the plurality of heating elements and further wherein there is at least one slit disposed between adjacent heating elements.

2. The liquid dispenser according to claim 1, wherein the heating elements each include two resistors, arranged in a substantially parallel manner and connected to each other at a first end of each resistor, which are energized by applying a voltage between the first end and a second end of the resistors; the slits extend toward the second end of the resistors; and the protective layer has portions that each cover at least one of the heating elements adjacent to each other and wherein the protective layer portions separated by the slits connect with each other at the side close to the first end of the resistors.

3. A printer comprising:

a liquid dispenser comprising a substrate and a plurality of liquid-dispensing portions, arranged on the substrate, each liquid dispenser including at least one liquid chamber for storing liquid, one nozzle, and one heating element, wherein the heating elements are energized to heat liquid stored in the corresponding liquid chambers to eject a droplet of the liquid from the corresponding nozzles; the heating elements and the liquid chambers have a protective layer and an insulating layer the insulating layer isolates the protective layer from the heating elements;

and the protective layer protects the heating elements, and has a strip shape with at least one slit disposed between adjacent heating elements.

* * * * *